United States Patent [19]

Sommer

[11] Patent Number: 4,688,516

[45] Date of Patent: Aug. 25, 1987

[54] DEVICE FOR COATING WEBS OF MATERIAL TRAVELING OVER A BACKING ROLL TO A CONTROLLED THICKNESS

[75] Inventor: Herbert Sommer, Dusseldorf, Fed. Rep. of Germany

[73] Assignee: Jagenberg AG, Dusseldorf, Fed. Rep. of Germany

[21] Appl. No.: 682,224

[22] Filed: Dec. 17, 1984

[30] Foreign Application Priority Data

Jan. 7, 1984 [DE] Fed. Rep. of Germany ..... 3400381

[51] Int. Cl.[4] ..... B05C 5/02

[52] U.S. Cl. ..... 118/410; 118/413

[58] Field of Search ..... 118/410, 413

[56] References Cited

U.S. PATENT DOCUMENTS

| | | | |
|---|---|---|---|
| 2,033,379 | 3/1936 | Jenkins et al. | 118/101 |
| 2,796,846 | 6/1957 | Trist | 118/413 X |
| 4,369,731 | 1/1983 | Damrau | 118/413 X |
| 4,396,648 | 8/1983 | Holt et al. | 118/413 X |

FOREIGN PATENT DOCUMENTS

| | | | |
|---|---|---|---|
| 2359413 | 2/1982 | Fed. Rep. of Germany | 118/410 |

*Primary Examiner*—John P. McIntosh

*Attorney, Agent, or Firm*—Sprung Horn Kramer & Woods

[57] ABSTRACT

A device for coating webs of material traveling over a backing roll to a controlled thickness, in which the coating material can be applied to the web with a slotted nozzle that extends over the total width of the web and in which the nozzle has an initial-flow regulation gap downstream of which a flow-regulation lip and an excess-removal lip demarcate a flow-regulation chamber. To allow more uniform and higher-quality application of the coating medium and, in particular, to ensure heavier coating weights and improved web printability with simple means, a barrier that demarcates the flow-regulation chamber from the traveling web of material is positioned to the vicinity of the excess-removal lip. The barrier can consist of a knife-like sheet-metal spring, of a roll, of a strip, or of a jet directed opposite to the direction in which the web is traveling. The barrier prevents an isolating layer of air from penetrating into the flow-regulation chamber.

5 Claims, 6 Drawing Figures

FIG. 4
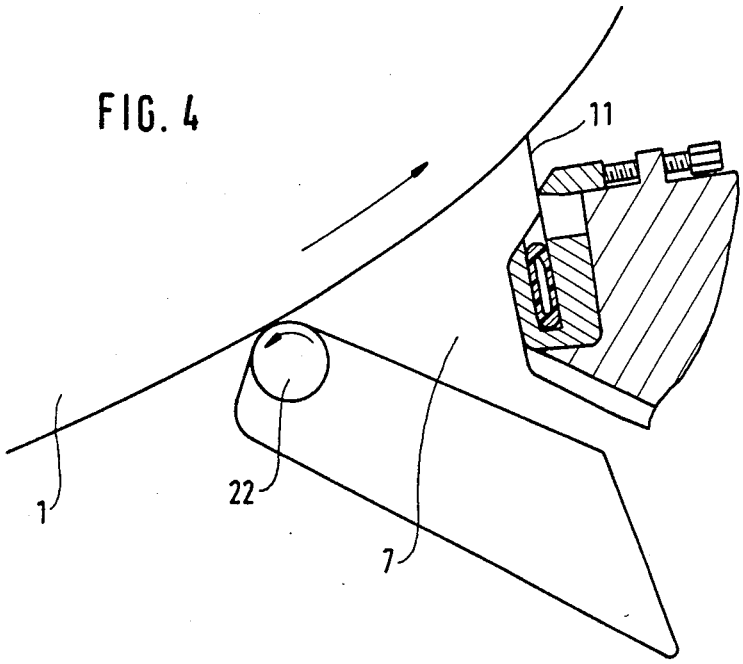
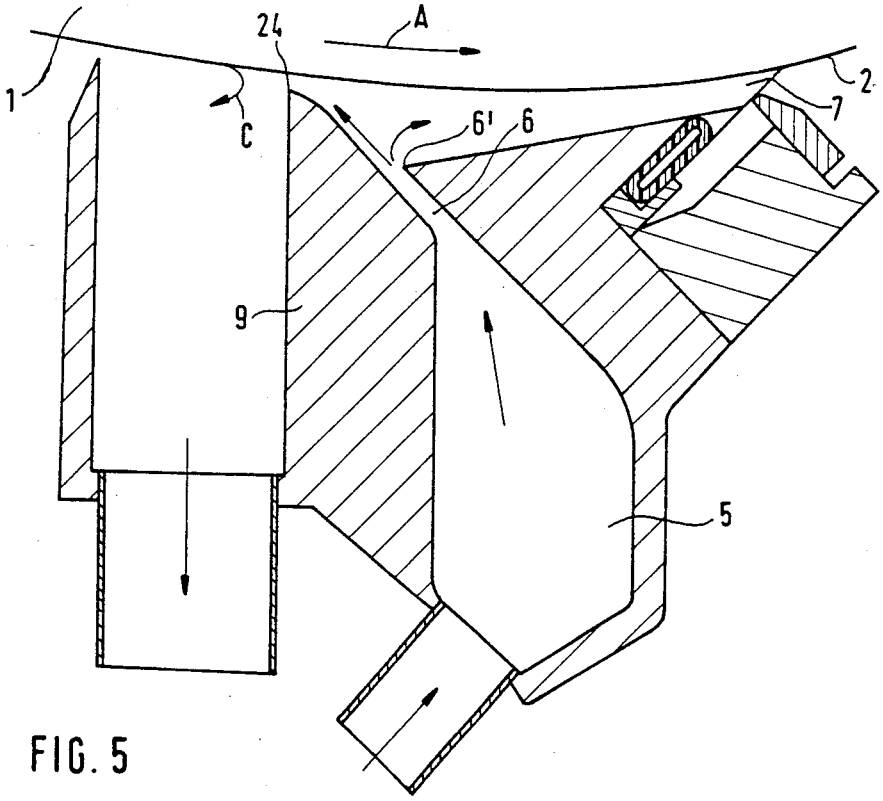
FIG. 5

DEVICE FOR COATING WEBS OF MATERIAL TRAVELING OVER A BACKING ROLL TO A CONTROLLED THICKNESS

BACKGROUND OF THE INVENTION

The present invention relates to a device for coating webs of material traveling over a backing roll to a controlled thickness, in which the coating medium can be applied to the web with a slotted nozzle that extends over the total width of the web and in which the nozzle has an initial-flow regulation gap downstream of which a flow-regulation lip and an excess-removal lip demarcate a flow-regulation chamber.

A device of this type is known, from German Patent No. 2 359 413 for example. It has a fixed-adjustable flow-regulation gap that generates a coating excess in the vicinity of the flow-regulation lip. The flow-regulation gap requires very precise adjustment with respect to both the speed at which the web is traveling and to the rheology of the coating medium. Fine flow regulation is controlled up-web in the known device by means of a separate doctor mechanism.

It has been demonstrated that a circulating web of material can, especially when it is traveling at high speeds, force an isolating layer of air into the flow-regulation chamber, leaving certain points on the web uncoated. Furthermore, the coating weights that can be obtained are very light and the uptake of printing ink is not uniform enough for the quality now ordinarily demanded.

SUMMARY OF THE INVENTION

The object of the present invention is to provide a device of the aforesaid type that will allow more uniform and higher-quality application of the coating medium and will, in particular, ensure heavier coating weights and improved web printability with simple means. Furthermore, the risk of uncoated points on the web, which has up to now been decreased, and that only to some extent, by circulating the coating medium at unacceptably high rates, will be completely eliminated.

This object is attained in accordance with the invention by positioning a barrier that demarcates the flow-regulation chamber from the traveling web of material in the vicinity of the excess-removal lip. The barrier prevents the isolating layer of air from penetrating into the flow-regulation chamber. Thus, the air cannot get to the flow-regulation lip and there will no longer be uncoated points on the web, even at machine speeds of more than 600–700 m/min.

The barrier can be designed in large number of ways. It can for example consist of a knife-like sheet-metal spring, of a roll, or of a strip or similar structure extending between the excess-removal lip and the web of material.

To obtain the desired effect, the barrier is preferably positioned on one shank of an excess-removal component that also creates an overflow in the coating medium. This provides satisfactory positioning and stability for the barrier.

If the barrier is a sheet-metal spring, it can be positioned at an acute angle to the excess-removal lip.

Naturally, the sheet-metal spring can be adjustable in relation to the web of material.

It is a definite advantage in certain applications for the free terminal edge of the sheet-metal spring to extend between the web of material and the excess-removal lip into the vicinity of the flow-regulation lip. This will to a certain extent generate a compulsory flow inside the flow-regulation chamber, with the result that the coating medium will wet only a relatively short stretch of the web and will generally be forced back along the sheet-metal spring in a direction opposite the one the web is traveling in, over the excess-removal lip, and into the excess-removal component.

If the barrier is a roll, it can be mounted in a resilient bed and, if need be, can have a coolant flowing through it. This also effectively helps to prevent the isolating layer of air from penetrating.

It is also possible in this case for the roll to be driven in a direction opposite the one in which the web is traveling. This even more effectively helps to prevent the isolating layer of air from penetrating.

In one significant embodiment of the invention, the excess-removal lip is positioned in relation to the outlet from the flow-regulation chamber in such a way that the adjacent initial-flow regulation gap extends in a direction essentially opposite the one the web is traveling in and accordingly creates a barrier jet. This even more effectively helps to prevent the isolating layer of air from penetrating.

It also then becomes possible to obtain a compulsory flow by appropriate means, with, for example, the surface of the initial-flow regulation gap that faces away from the flow-regulation lip merging in an arc into the excess-removal lip at a curvature less than or equal to 0.012 $mm^{-1}$ and creating in conjunction with the backing roll a gap of 3 to 8 mm, with a flow-breakdown edge on the surface of the initial-flow regulation gap facing the flow-regulation lip.

To increase coating weight and improve the printability of the web, the flank of the excess-removal component on the side of the excess-removal lip facing away from flow-regulation lip in one embodiment of the invention is also designed as a support for an initial-flow regulating device that is adjacent to an overflow lip.

The initial-flow regulating device has a doctor strip that slides on at least one flat surface of a stop rail and a sharp tearoff edge on the doctor strip can be forced against the web of material with an elastic means of pressure. This structure eliminates the drawbacks of the known devices that result for example when no initial-flow regulating devices are present. Thus, it is impossible with application rolls in flooded-nip coaters to apply heavy coating weights, when, that is, the pressure from the flow-regulating mechanism is low, because printability would be considerably less satisfactory than with roll-application systems. The reason is the lack of an initial flow-regulation point to de-water the layer of coating medium next to the paper and immobilize it in order to prevent non-uniform penetration of coating medium during the subsequent flow-regulation.

Some preferred embodiments of the invention will now be described with reference to the accompanying drawings, wherein

BRIEF DESCRIPTION OF THE DRAWINGS

FIG. 4 is a schematic partially sectional view of a device with a powered roll, FIG. 5 is a schematic partially sectional view of a device with a specially designed initial-flow regulation gap.

DETAILED DESCRIPTION OF THE PREFERRED EMBODIMENTS

Figure 1:
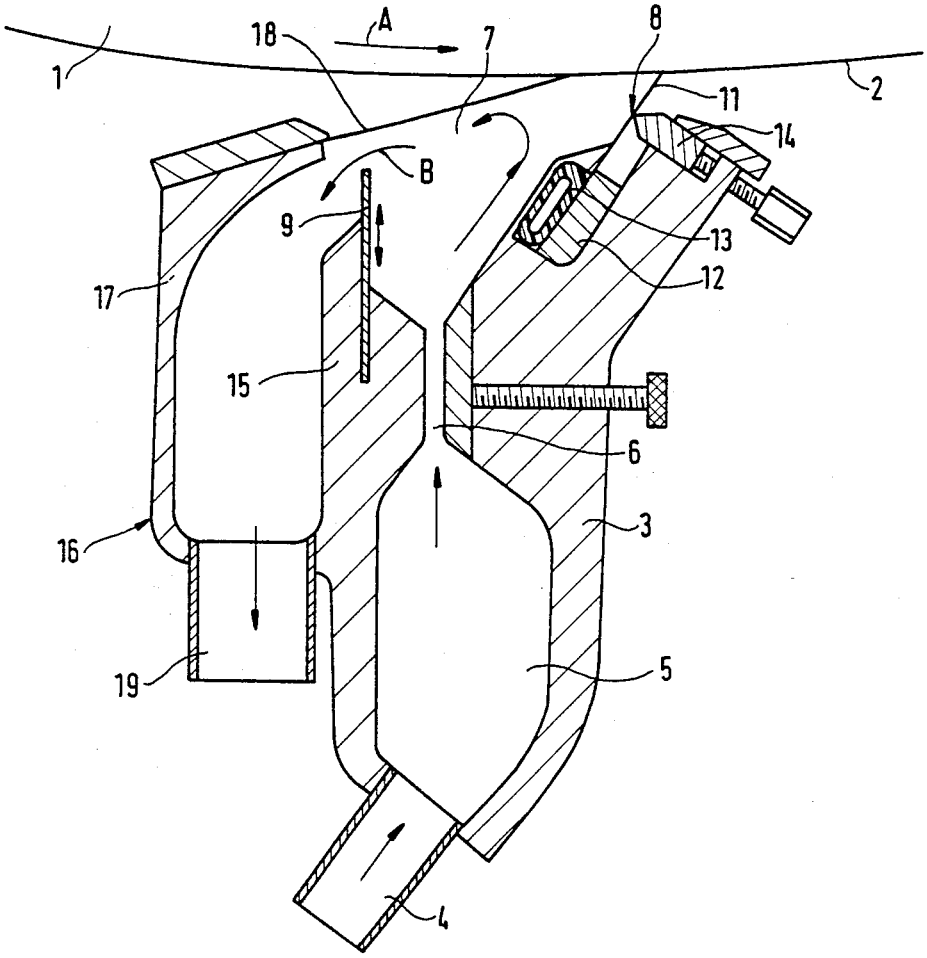
FIG. 1 is a schematic partially sectional view of a device in accordance with the invention.

The device, schematically illustrated in FIG. 1, for regulating the flow of a coating medium to a web 2 of material traveling over a backing roll 1 in the direction indicated by arrow A has a slotted nozzle 3 that extends over the width of the web. Slotted nozzle 3 consists of an access pipe 4, an initial-flow regulation chamber 5, an adjustable initial-flow regulation gap 6, and a flow-regulation chamber 7. One side of flow-regulation chamber 7 is demarcated by a flow-regulation lip 8 and the other side by an excess-removal lip 9. The flow-regulation lip 8 in the illustrated embodiment consists of a coating knife 11. One side of the bottom of coating knife 11 rests against a clamping beam 12 and the other against a compressed-air hose 13. Coating knife 11 is also supported by an adjustable comb strip 14. Excess-removal lip 9 is mounted in such a way as to be adjustable axially in one shank 15 of an excess-removal component 16. A sheet-metal spring 18 is tensioned against the other shank 17. Sheet-metal spring 18 extends between excess-removal lip 9 and web 2 of material at an acute angle to lip 9. Since the free end of spring 18 extends into the vicinity of coating knife 11, only a comparatively short stretch of the web is exposed to flow-regulation chamber 7 at this point.

Extending from excess-removal component 16 is an excess-removal line 19 that leads, like access pipe 4, to a pump, not illustrated.

To prevent an isolating layer of air from penetrating into flow-regulation chamber 7 subject to the force of the circulating web 2 of material while the device is in operation, sheet-metal spring 18 extends tight against the web. The design and position of sheet-metal spring 18, which extends over the whole width of the web, also generates a compulsory flow of the coating medium in flow-regulation chamber 7, specifically in the direction indicated by arrow B. Obviously a doctor strip or doctor roll could be employed instead of coating knife 11.

Figure 2:
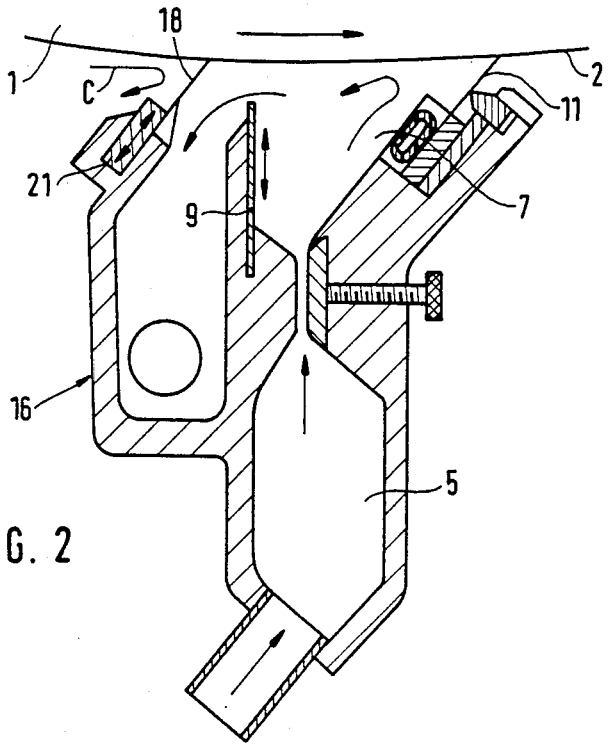
FIG. 2 is a schematic partially sectional view of the device with an adjustable sheet-metal spring.

The embodiment illustrated in FIG. 2 differs in that sheet-metal spring 18 is positioned at a different angle, specifically such that it comes to rest against web 2 of material behind excess-removal lip 9, preventing penetration of the isolating layer of air in direction indicated by arrow C. Otherwise, the coating medium essentially flows as illustrated in FIG. 1. Sheet-metal spring 18 is provided with an adjuster 21 to adapt it to varying situations.

Figure 3:
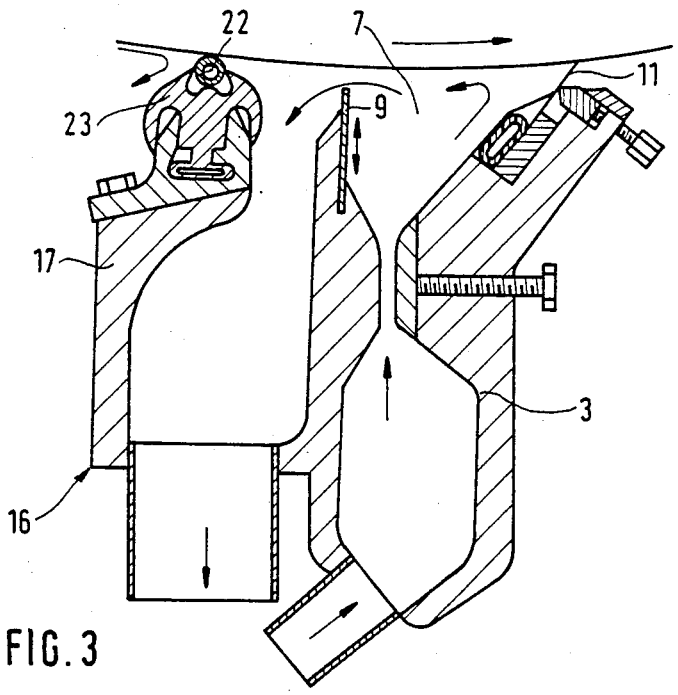
FIG. 3 is a schematic partially sectional view of an embodiment with a doctor roll.

The embodiment illustrated in FIG. 3 has a roll 22 instead of sheet-metal spring 18. Preferably, coolant can flow through roll 22. The roll is positioned in a resilient bed 23, which is itself positioned on and secured to one shank 17 of excess-removal component 16.

FIG. 4 illustrates one variant of the embodiment illustrated in FIG. 3, in which roll 22 is driven in a direction opposite the one in which backing roll 1 rotates and in which roll 22 and backing roll 1 are positioned in such a way as to leave a nip.

The gap 24 at the excess-removal lip 9 in the embodiment illustrated in FIG. 5 is positioned with respect to initial-flow regulation chamber 5 so that initial-flow regulation gap 6 extends in such a way as to create a barrier jet in a direction opposite the one in which web 2 of material travels. This also effectively helps to prevent isolating layer of air C from penetrating into flow-regulation chamber 7. The transition between gap 24 and initial-flow regulation gap 6 is, in a practical way, rounded to generate a beneficial flow. The curvature is less than or equal to 0.012 $mm^{-1}$. There is a flow-breakdown edge 6' on the surface of initial-flow regulation gap 6 that faces the flow-regulation lip. This design results in a comparatively large flow-regulation chamber 7.

Figure 6:
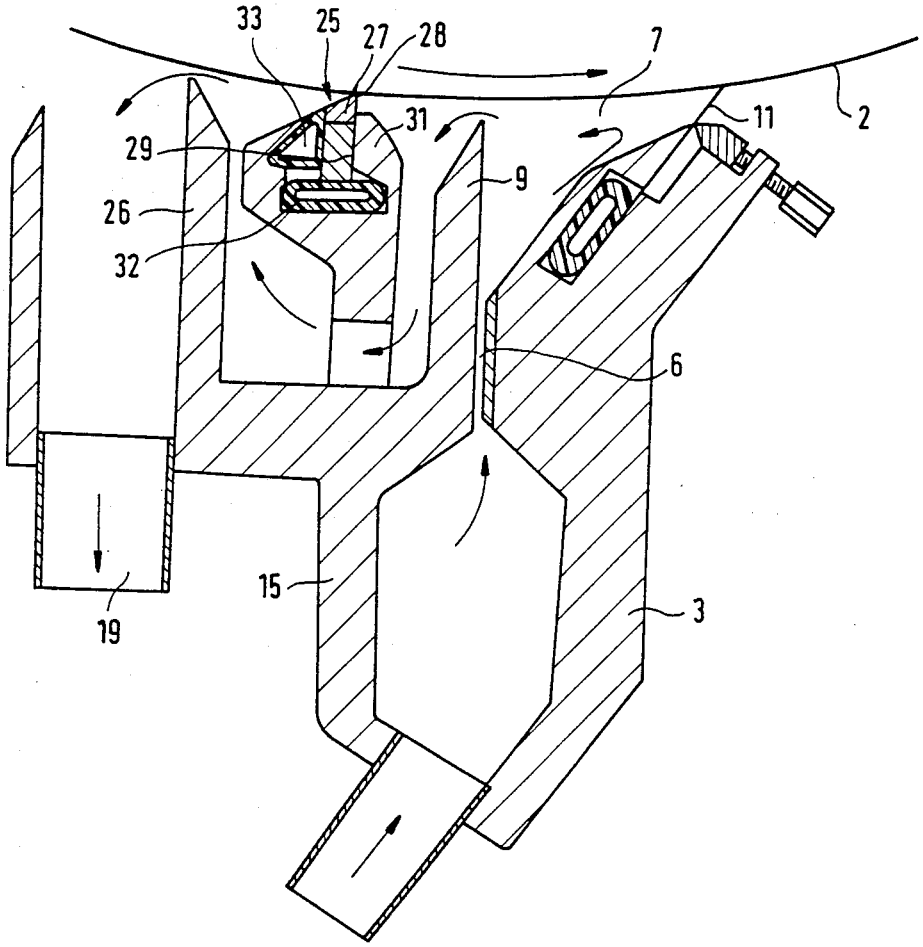
FIG. 6 is a schematic partially sectional view of with an initial-flow regulating device.

The embodiment illustrated in FIG. 6 also has an initial-flow regulating device 25 to increase the coating weight and improve printability. One shank 15 of excess-removal component 16 is accordingly designed as a mount for initial-flow regulating device 25. Initial-flow regulating device 25 extends on one side between excess-removal lip 9 and an overflow lip 26. Excess-removal line 19 connects behind overflow lip 26. Initial-flow regulating device 25 consists of a doctor strip 27 with a sharp tearoff edge 28 that rests against web 2 of material. Doctor strip 27 slides along at least one flat surface 29 of a stop rail 31.

A compression hose 32, charged with air, functions as an elastic means of applying contact pressure. The elasticity of compressed-air hose 32 ensures uniform pressure of doctor strip 27 against the web 2 of material traveling over backing roll 1 along the total working width. The linear pressure applied by the hose maintains equilibrium with the hydrodynamic pressure in the wedge-shaped gap under the face of doctor strip 27. The pressure in the hose can accordingly be varied to adjust coating weight with high precision, uniformity, and continuity. The equilibrium between hydrodynamic and doctor pressure is constant at every point along the working width without the need for additional contouring devices. This is a prerequisite for uniform coating depth. Another compressed-air hose 33 presses against doctor strip 27 and, when its pressure is high enough, can maintain it in any position that has previously been established.

It is understood that the specification and examples are illustrative but not limitative of the present invention and that other embodiments within the spirit and scope of the invention will suggest themselves to those skilled in the art. Thus, the doctor strip in initial-flow regulating device can be differently designed, in the form of a doctor roll for example. There can also be a doctor strip or doctor roll instead of coating knife 11 at the flow-regulation lip.

I claim:

1. In a device for coating a web of material traveling over a backing roll to obtain a controlled thickness of that coating, the device comprising a slotted nozzle extending over the full width of the web and means for supplying coating medium to the nozzle, wherein the nozzle has an initial-flow-regulation gap and a flow-regulation chamber downstream of the initial-flow-regulation gap and demarcated by a flow-regulation lip and an excess-removal lip, the improvement wherein the excess removal lip comprises a continuous extension from the initial-flow regulation gap and the initial-flow regulation gap extends in a direction to direct flow opposite to the direction of travel of the web to form a barrier jet of coating medium.

2. The device according to claim 1, wherein the initial-flow regulation gap has a surface that faces away from the flow-regulation lip and merges in an arc into the excess-removal lip at a curvature up to 0.012 $mm^{-1}$ and creates, in conjunction with the backing roll, a gap of 3 to 8 mm, with a flow-breakdown edge on the surface of the initial-flow regulation gap facing the flow-regulation lip.

3. In a device for coating a web of material traveling over a backing roll to obtain a controlled thickness of that coating, the device comprising a slotted nozzle extending over the full width of the web and means for supplying coating medium to the nozzle, wherein the nozzle has an initial-flow-regulation gap and a flow-regulation chamber downstream of the initial-flow-regulation gap and demarcated by a flow-regulation lip and an excess-removal lip, the improvement wherein the excess removal lip comprises a continuous extension from the initial-flow regulation gap medium and extends to the vicinity of the web to direct flow in a direction perpendicular to the direction of travel of the web and further comprising an overflow lip upstream of the excess-removal lip and means forming a barrier positioned between the overflow lip and the excess removal lip and comprising a resilient initial-flow regulating device.

4. The device according to claim 3, wherein the excess-removal lip has a component mounted on a support shank and wherein the initial-flow regulating device is supported on said shank.

5. A device according to claim 3, wherein the initial-flow regulating device includes a stop rail having a flat surface, a doctor strip sliding on the flat surface, a sharp tear-off edge on the doctor strip, and an elastic pressure means resiliently forcing the sharp tear-off strip against the web of material.

* * * * *